US011813622B2

(12) United States Patent
Peterson

(10) Patent No.: US 11,813,622 B2
(45) Date of Patent: Nov. 14, 2023

(54) SHOWERHEAD WITH INLINE ENGINE PORTING

(71) Applicant: WATER PIK, INC., Fort Collins, CO (US)

(72) Inventor: Preston Peterson, Loveland, CO (US)

(73) Assignee: WATER PIK, INC., Fort Collins, CO (US)

( * ) Notice: Subject to any disclaimer, the term of this patent is extended or adjusted under 35 U.S.C. 154(b) by 311 days.

(21) Appl. No.: 16/885,090

(22) Filed: May 27, 2020

(65) Prior Publication Data

US 2020/0376505 A1 Dec. 3, 2020

Related U.S. Application Data

(60) Provisional application No. 62/854,202, filed on May 29, 2019.

(51) Int. Cl.

| | |
|---|---|
| ***B05B 1/18*** | (2006.01) |
| ***E03C 1/04*** | (2006.01) |
| ***B05B 1/16*** | (2006.01) |
| *B05B 1/30* | (2006.01) |

(52) U.S. Cl.

CPC ..... *B05B 1/185* (2013.01); *B05B 1/1636* (2013.01); *E03C 1/0405* (2013.01); *B05B 1/3026* (2013.01)

(58) Field of Classification Search

CPC ..... B05B 1/185; B05B 1/1636; B05B 1/3026; B05B 1/1663; B05B 1/18; B05B 1/30; E03C 1/0405; E03C 1/0409

See application file for complete search history.

(56) References Cited

U.S. PATENT DOCUMENTS

| | | | | |
|---|---|---|---|---|
| 2,132,333 | A * | 10/1938 | Wendell et al. | B05B 1/1654 239/394 |
| 4,013,230 | A | 3/1977 | Gondek | |
| 6,230,989 | B1 | 5/2001 | Haverstraw et al. | |
| 7,017,837 | B2 * | 3/2006 | Taketomi | E03C 1/084 239/443 |
| 7,100,845 | B1 * | 9/2006 | Hsieh | B05B 1/1627 239/582.1 |
| 7,320,442 | B2 | 1/2008 | Bosio | |
| 7,670,305 | B2 | 3/2010 | Zhadanov et al. | |
| 8,348,181 | B2 * | 1/2013 | Whitaker | B05B 1/1636 239/443 |
| 8,550,380 | B2 | 10/2013 | Gautschi et al. | |
| 8,616,470 | B2 | 12/2013 | Williams | |
| 9,027,857 | B2 | 5/2015 | Kull | |

(Continued)

FOREIGN PATENT DOCUMENTS

| | | |
|---|---|---|
| CN | 1333706 | 1/2002 |
| CN | 201419131 | 3/2010 |

(Continued)

*Primary Examiner* — Qingzhang Zhou
*Assistant Examiner* — Joel Zhou
(74) *Attorney, Agent, or Firm* — Dorsey & Whitney LLP

(57) ABSTRACT

A showerhead with inline engine porting is provided. The showerhead may include a housing defining a fluid inlet pathway and an engine rotatably mounted to the housing. The engine may include a series of ports defined within a sidewall of the engine. The series of ports may be associated with different flow pathways defined within the engine. Rotation of the engine relative to the housing may selectively align the fluid inlet pathway with one of the series of ports.

20 Claims, 7 Drawing Sheets

(56) References Cited

U.S. PATENT DOCUMENTS

| | | | |
|---|---|---|---|
| 9,138,755 | B2 | 9/2015 | Schroeder |
| 9,138,756 | B2 | 9/2015 | Schroeder |
| 9,199,252 | B2 | 12/2015 | Schorn et al. |
| 9,272,295 | B2 | 3/2016 | Esche et al. |
| 9,278,364 | B2 | 3/2016 | Zhou et al. |
| 9,289,785 | B2 | 3/2016 | Buehler et al. |
| 9,421,561 | B2 * | 8/2016 | Yaita ..... E03C 1/0405 |
| 9,438,977 | B2 | 9/2016 | Wang et al. |
| 9,566,593 | B2 | 2/2017 | Marty et al. |
| 9,573,142 | B2 | 2/2017 | Zhou et al. |
| 9,764,339 | B2 | 9/2017 | Yu |
| 9,829,116 | B2 | 11/2017 | Xu et al. |
| 9,901,939 | B2 | 2/2018 | Lin et al. |
| 2010/0065665 | A1 | 3/2010 | Whitaker et al. |
| 2017/0100728 | A1 | 4/2017 | Gong et al. |
| 2017/0120264 | A1 | 5/2017 | Lin et al. |
| 2017/0239673 | A1 | 8/2017 | Kajuch |
| 2017/0320084 | A1 | 11/2017 | Lin et al. |
| 2018/0001331 | A1 | 1/2018 | Lin et al. |

FOREIGN PATENT DOCUMENTS

| | | | |
|---|---|---|---|
| CN | 104069964 | | 10/2014 |
| CN | 104174515 | | 12/2014 |
| CN | 106061618 | A | 10/2016 |
| CN | 207076569 | | 3/2018 |
| CN | 102019237 | | 4/2021 |
| DE | 202010005256 | | 5/2011 |
| EP | 2711084 | | 3/2014 |
| WO | 2015075256 | | 5/2015 |
| WO | 2015196618 | | 12/2015 |
| WO | 2017191427 | A1 | 11/2017 |

* cited by examiner

SHOWERHEAD WITH INLINE ENGINE PORTING

CROSS-REFERENCE TO RELATED APPLICATIONS

This application claims the benefit of priority pursuant to 35 U.S.C. § 119(e) of U.S. Provisional Application No. 62/854,202, filed May 29, 2019, entitled "Showerhead with Inline Engine Porting," which is hereby incorporated herein by reference in its entirety.

TECHNICAL FIELD

The present disclosure relates generally to showerheads and more specifically to showerheads with inline engine porting.

BACKGROUND

Showerheads are generally used to direct water from a water supply onto a user, animal, or object, such as for personal hygiene purposes and/or cleansing purposes. Many showerheads include engines or structures that allow a user to select one of a multiple of showerhead operation modes, each operation mode emitting streams of water with different characteristics. For example, some showerheads may include a massage mode that emits pulsating streams of water, a concentration mode that emits water into a relatively small pattern, and a drenching mode that emits water in a steady, soft spray pattern.

Showerheads typically include an inlet water path that extends through the housing or handle of the showerhead and then turns at approximately 90 degrees to enter the showerhead's engine through one of a series of apertures or ports formed in a back surface of the engine. The water path typically requires a showerhead with a form factor having a relatively substantial cross-section to accommodate the water path. The water path may also reduce fluid pressure within the showerhead due to the turns in the water path.

It is therefore desirable to provide an improved showerhead that addresses at least in part the above described problems and/or which more generally offers improvements or an alternative to existing arrangements.

SUMMARY

The present disclosure generally provides a showerhead with inline engine porting that replaces the 90-degree water pathway in traditional showerhead engines. Generally, water enters through the side of the engine, such as through a sidewall, instead of entering through the back of the engine. The side of the engine may include a series of apertures or ports associated with different flow pathways within the engine, with the different flow pathways corresponding to different operation modes of the showerhead. The series of apertures or ports are positioned, such as being horizontally aligned and spaced along the side of the engine, such that rotation of the engine relative to the showerhead's housing selectively aligns a fluid inlet pathway defined by the showerhead housing (e.g., a handle of the showerhead) with one of the apertures or ports. The showerhead may include a snap ring positioned or received between the engine and the housing, such as received in corresponding annular grooves, to rotatably mount the engine to the housing.

According to one aspect of the present disclosure, a showerhead is provided. The showerhead may include a housing defining a fluid inlet pathway, and an engine rotatably attached to the housing. The engine may include a series of ports opening though an external sidewall of the engine, and the series of ports may be associated with different flow pathways defined within the engine. The engine may be rotated relative to the housing to selectively align the fluid inlet pathway with one or more ports of the series of ports.

Additional features are set forth in part in the description that follows and will become apparent to those skilled in the art upon examination of the specification and drawings or may be learned by the practice of the disclosed subject matter. A further understanding of the nature and advantages of the present disclosure may be realized by reference to the remaining portions of the specification and the drawings, which forms a part of this disclosure.

One of skill in the art will understand that each of the various aspects and features of the disclosure may advantageously be used separately in some instances, or in combination with other aspects and features of the disclosure in other instances. Accordingly, individual aspects can be claimed separately or in combination with other aspects and features. Thus, the present disclosure is merely exemplary in nature and is in no way intended to limit the claimed invention or its applications or uses. It is to be understood that structural and/or logical changes may be made without departing from the spirit and scope of the present disclosure.

The present disclosure is set forth in various levels of detail and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. The claimed subject matter is not necessarily limited to the arrangements illustrated herein, with the scope of the present disclosure is defined only by the appended claims.

BRIEF DESCRIPTION OF THE DRAWINGS

The description will be more fully understood with reference to the following figures in which components may not be drawn to scale, which are presented as various embodiments of the showerhead described herein and should not be construed as a complete depiction of the scope of the showerhead.

DETAILED DESCRIPTION

Figure 1:
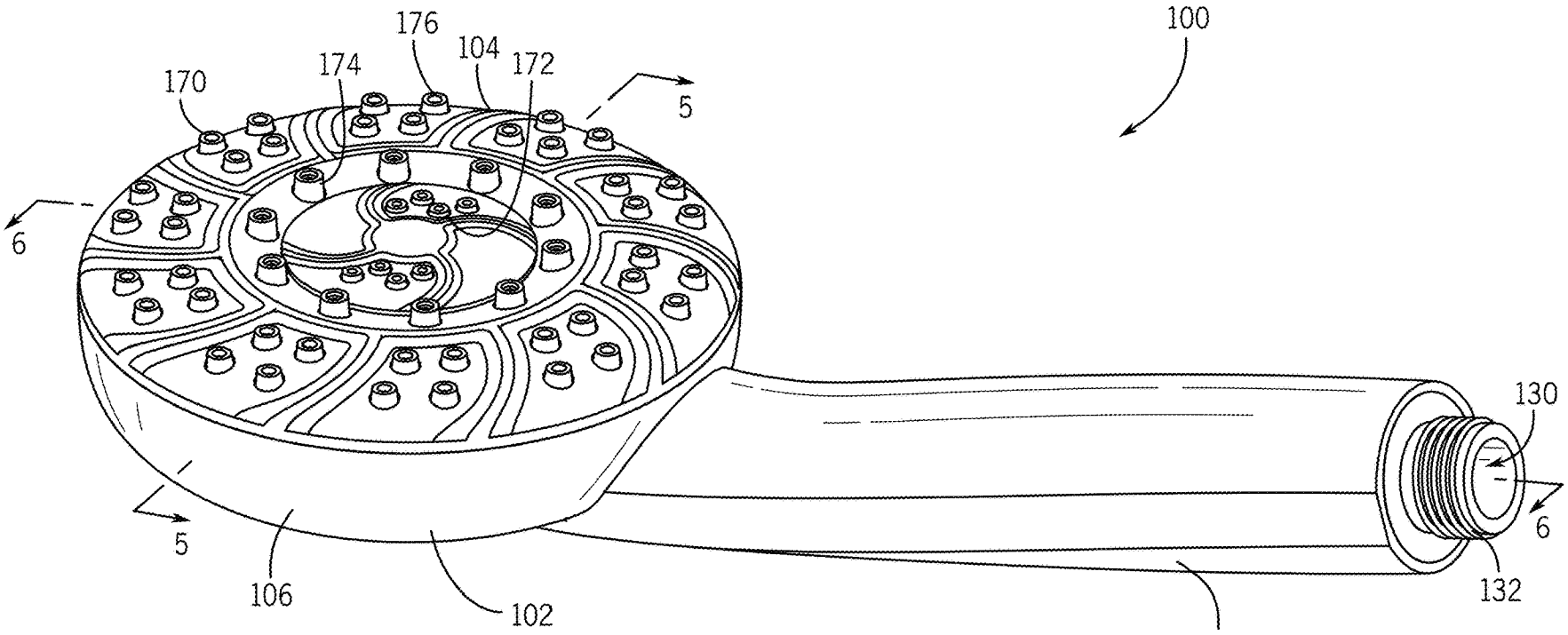
FIG. 1 is an isometric view of a showerhead according to some examples of the present disclosure.

A showerhead is provided that includes inline engine porting. Specifically, fluid (e.g., water) enters the engine through a side, instead of a back, of the engine. To change the operation mode of the showerhead, a user can rotate the engine relative to the showerhead's housing to selectively align one of a series of apertures or ports formed in the side of the engine with a fluid inlet pathway defined by the housing. Each aperture or port may be associated with a different operation mode of the showerhead.

The inline engine porting described herein may allow the showerhead to have a reduced form factor, such as thinner, compared to traditional multi-mode showerheads due at least in part to water being ported through a side (e.g., a side surface or sidewall) of the engine, rather than being ported through a rear (e.g., a rear surface or back wall) of the engine. The inline engine porting may increase the force of water exiting the showerhead because of improved fluid dynamics in the flow path. For example, by porting water through a side of the engine, instead of its back, a pressure reducing 90-degree or similar turn found in traditional showerheads is removed from the flow path.

The showerhead engine defines the various operation modes of the showerhead. To set the operation mode of the showerhead, a user can rotate the engine relative to the housing to selectively align the fluid inlet pathway with one of the series of apertures or ports formed in the side of the engine that is associated with the desired operation mode of the showerhead. The engine may be attached to the showerhead's housing in various manners. In some examples, the engine may be attached to the housing via a snap ring, rather than by fasteners, to facilitate attachment of the engine to the housing, such as providing a cost-effective process of attaching the engine to the housing. In other examples, the engine may be attached to the housing via one or more fasteners or in other manners.

Referring to FIGS. 1-3 and 6, a showerhead 100 may include a housing 102 defining a fluid inlet pathway 130 for the showerhead 100. The fluid inlet pathway 130 receives fluid (e.g., water) from a fluid source, such as a hose, J-pipe, or the like and transports the fluid to the engine 200 of the showerhead 100. To connect the showerhead 100 to the fluid source, the housing 102 may include threading 132 or another connection feature.

Figure 2:
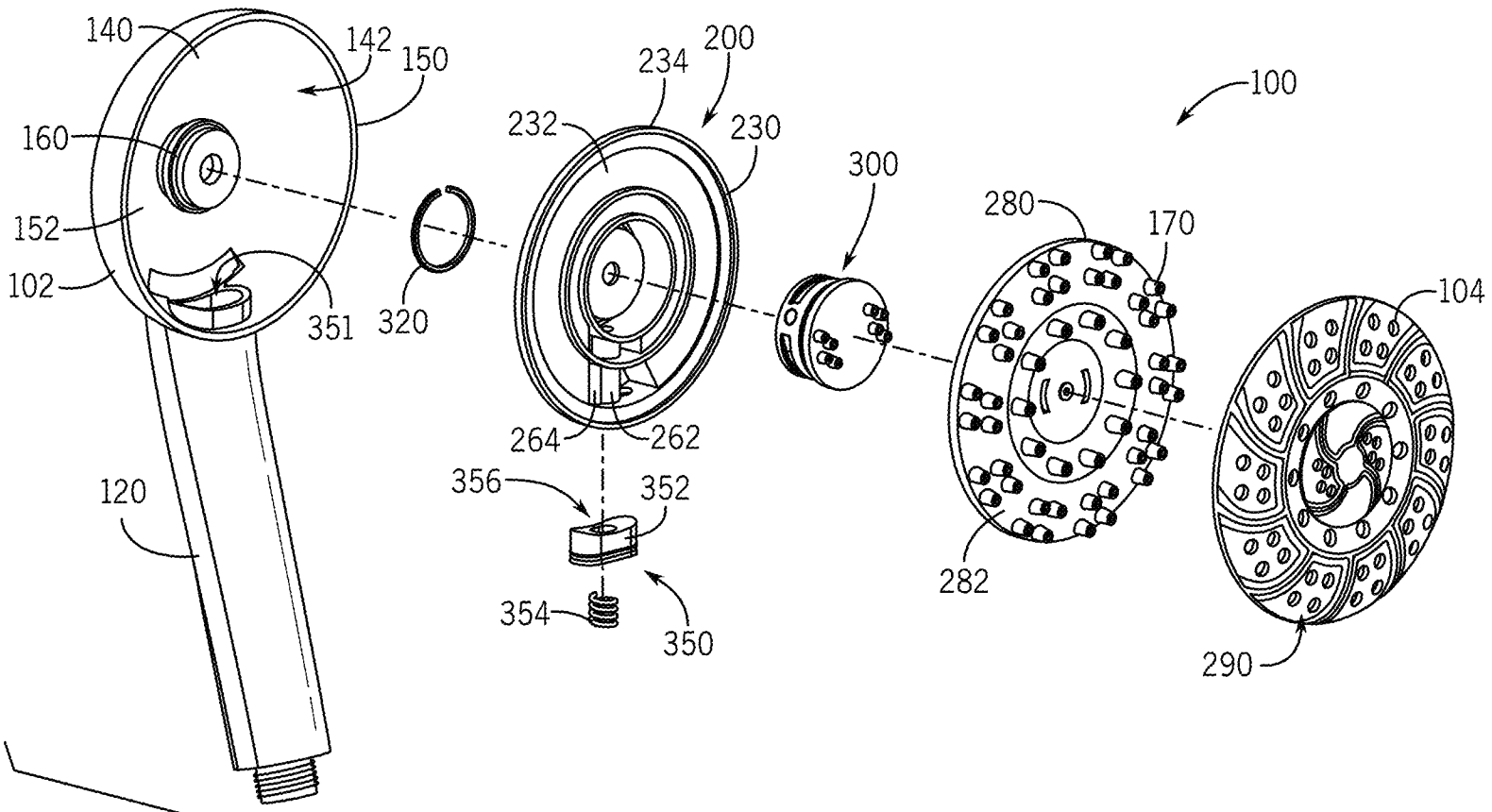
FIG. 2 is a front exploded view of the showerhead of FIG. 1 according to some examples of the present disclosure.

The housing 102 of the showerhead 100 may include a spray head 106 to which the engine 200 is rotatably attached. As illustrated in FIG. 2, the spray head 106 may define an internal cavity 142 for receipt of the engine 200. For instance, the spray head 106 may be arcuately shaped, such as bowl shaped, with a sidewall 140 extending from a rear wall 152 to define the internal cavity 142. A faceplate 104 may be attached to a terminal edge or rim 150 of the sidewall 140 to enclose the internal cavity 142 (see FIG. 5). As shown in FIG. 2, a boss 160 may extend from the rear wall 152 of the spray head 106 into the internal cavity 142 for attachment of the engine 200 to the housing 102. The boss 160 may have a circular cross-section.

Figure 6:
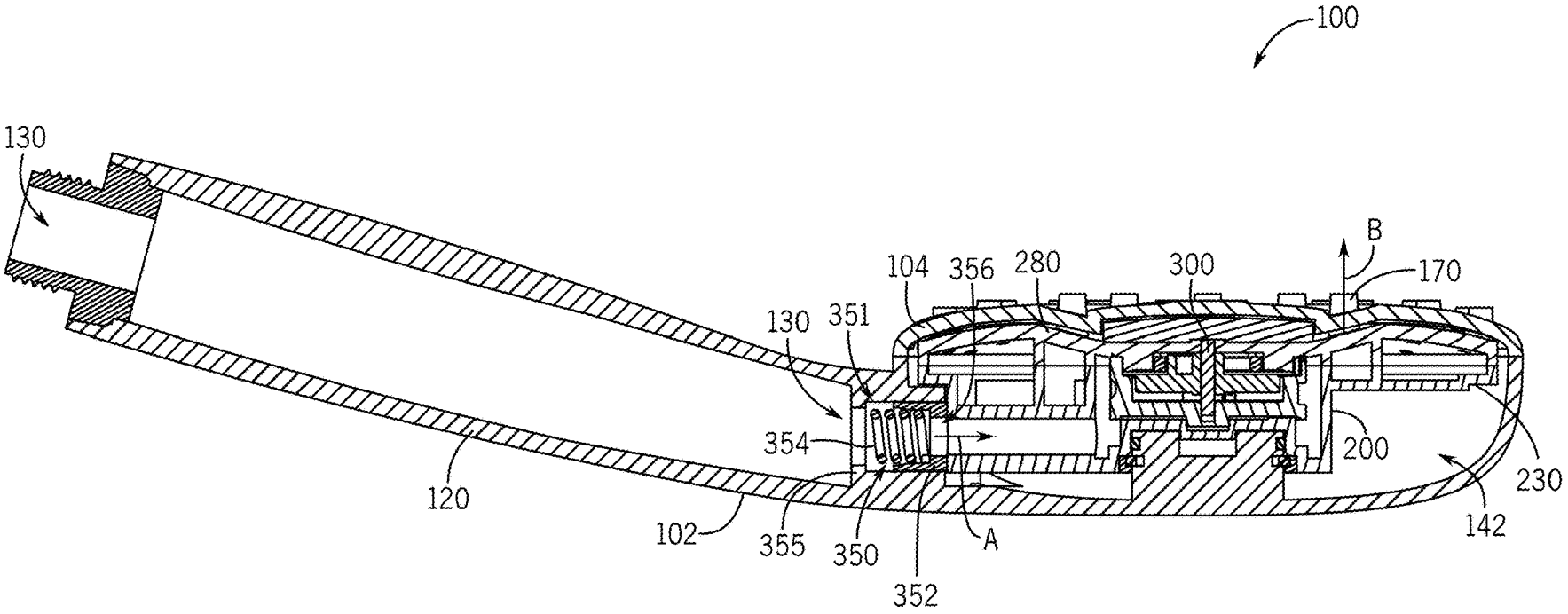
FIG. 6 is another cross-sectional view of the showerhead of FIG. 1 taken along line 6-6 in FIG. 1 according to some examples of the present disclosure.

As illustrated in FIGS. 1-3 and 6, the housing 102 may define an arm 120 extending from the spray head 106. The arm 120 may be an elongated member including a connection feature, such as threading 132, for connection to the fluid source. As illustrated in FIG. 6, the fluid inlet pathway 130 may extend within and along the length of the arm 120. The showerhead 100 may be a handheld showerhead (e.g., configured for attachment to a hose) or a fixed or wall mount showerhead (e.g., configured to be fixedly attached to the fluid source). In configurations in which the showerhead 100 is a handheld showerhead, the arm 120 may have a shape configured to be held comfortably in a user's hand, such as illustrated in FIGS. 1-3 and 6, and may be considered a handle.

Figure 3:
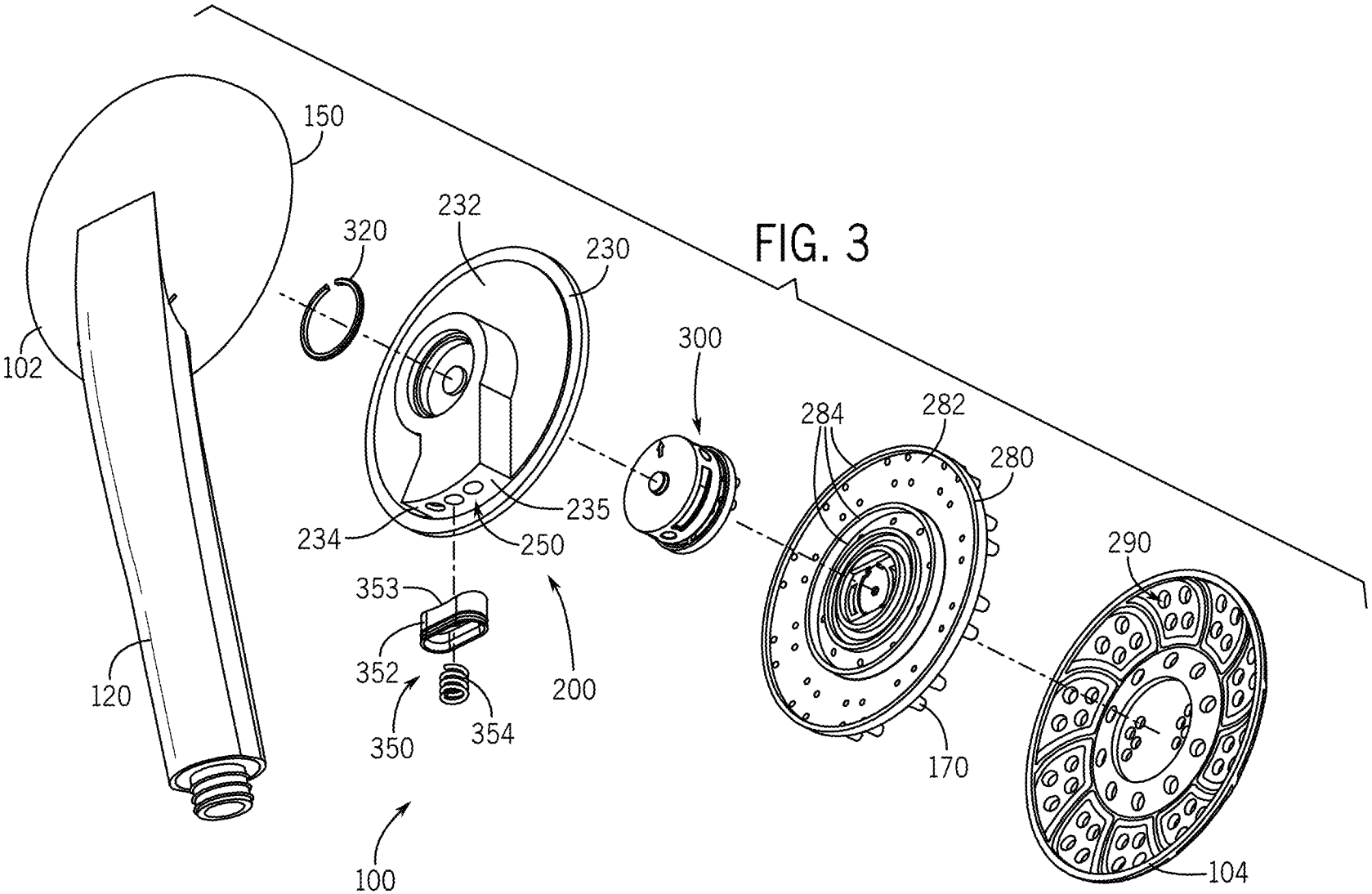
FIG. 3 is a rear exploded view of the showerhead of FIG. 1 according to some examples of the present disclosure.

Referring to FIGS. 1-3, the showerhead 100 may include a plurality of outlet nozzles 170. The outlet nozzles 170 may be arranged in one or more sets or groups, and each set or group may be associated with a different operation mode of the showerhead 100. For example, a first nozzle group 172 may be associated with a first operation mode of the showerhead 100, a second nozzle group 174 may be associated with a second operation mode of the showerhead 100, a third nozzle group 176 may be associated with a third operation mode, and so on. The operation modes of the showerhead 100 may include a full body mode, a massage mode, a mist mode, a concentrated mode, among others. The showerhead 100 may include a mode selector for a user to manipulate to switch the showerhead 100 between the different operation modes.

The outlet nozzles 170 may be raised protrusions having a lumen defined therethrough, apertures defined within the faceplate 104 itself, or different configurations. The lumens and/or apertures defining the outlet nozzles 170 may be configured to provide a fluid stream characteristic for the showerhead 100. The outlet nozzles 170 may be formed as part of the faceplate 104 or as part of another element of the showerhead 100.

Referring to FIGS. 1-6, the engine 200 is positioned within the internal cavity 142 of the spray head 106. The rotational position of the engine 200 relative to the spray head 106 determines the operation mode of the showerhead 100. In other words, the engine 200 directs the fluid from the fluid inlet pathway 130 to different subsets or groups of the outlet nozzles 170 depending on the position of the engine 200 relative to the spray head 106.

The engine 200 generally defines a different flow pathway for each operation mode of the showerhead 100. For example, the engine 200 may define a first flow pathway 210 associated with the first operation mode of the showerhead 100, a second flow pathway 212 associated with the second operation mode of the showerhead 100, a third flow pathway 214 associated with the third operation mode of the showerhead 100, and so on.

The rotational position of the engine 200 relative to the housing 102 determines which flow pathway defined within the engine 200 is active. For instance, the engine 200 may be positioned in a first position to align the fluid inlet pathway 130 with the first flow pathway 210 and place the showerhead 100 in the first operation mode. The engine 200 may be positioned in a second position to align the fluid inlet pathway 130 with the second flow pathway 212 and place the showerhead 100 in the second operation mode. The engine 200 may be positioned in a third position to align the fluid inlet pathway 130 with the third flow pathway 214 and place the showerhead 100 in the third operation mode, and so on. The engine 200 may be rotated between the various positions by a user to allow the user to easily select a desired operation mode of the showerhead 100.

As described herein, the engine 200 may be configured to receive fluid from the fluid inlet pathway 130 via inline porting. For instance, rather than fluid flowing through a high degree turn, such as a 90-degree turn, from the fluid inlet pathway 130 to the engine 200, fluid enters through a side portion of the engine 200 that is substantially in-line with the fluid inlet pathway 130. In other words, fluid is ported through a side portion (e.g., a sidewall) of the engine 200 rather than being ported through a rear portion (e.g., a back wall) of the engine. This inline porting characteristic provides improved fluid dynamics through the showerhead 100, which may increase the force of the fluid exiting the showerhead 100 compared to traditional designs. This inline porting characteristic allows the showerhead 100 to have a reduced form factor, such as a thinner spray head, compared to traditional designs in which fluid is ported through the back of the engine.

The engine 200 may include various components. For example, as shown in FIGS. 2-6, the engine 200 may include a flow control plate 230. The flow control plate 230 may be defined by a base wall 232 and at least one wall extending at an angle from the base wall 232 to define different flow pathways within the engine 200. The base wall 232 may be circular as shown or may include other suitable configurations providing one or more flow or attachment characteristics of the engine 200. In some examples, the engine 200 includes a plurality of walls to define the different flow pathways within the engine 200. For instance, the engine 200 may include a first wall 240 defining the first flow pathway 210 with the base wall 232, a second wall 242 defining the second flow pathway 212 with the base wall 232 and the first wall 240, a third wall 244 defining the third flow pathway 214 with the base wall 232 and the second wall 242, and so on.

Figure 4:
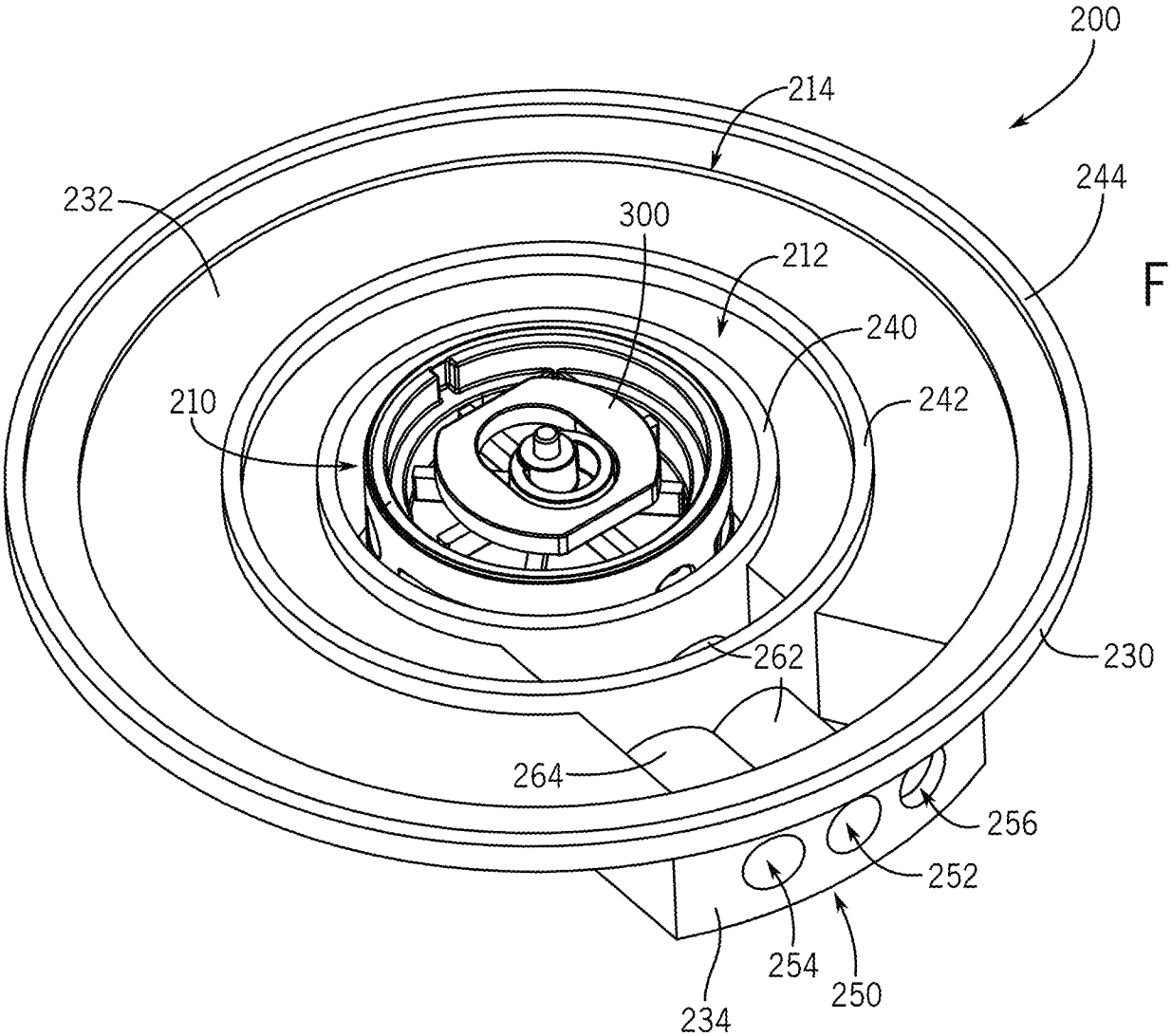
FIG. 4 is an isometric view of an engine of the showerhead of FIG. 1 with a nozzle plate removed for illustration purposes according to some examples of the present disclosure.

Referring to FIG. 4, a plurality or series of ports 250 may be defined within an external sidewall 234 of the engine 200 to provide inline porting from the fluid inlet pathway 130 to the engine 200. The series of ports 250 may be associated with the different flow pathways defined within the engine 200. For instance, a first port 252 may be in fluid communication with the first flow pathway 210, a second port 254 may be in fluid communication with the second flow pathway 212, and a third port 256 may be in fluid communication with the third flow pathway 214. The ports 250 may be positioned to facilitate inline porting from the fluid inlet pathway 130 to the engine 200 as the engine 200 is switched between its various positions. As illustrated in FIG. 3, the external sidewall 234 of the engine 200 may be positioned between front and rear surfaces of the engine 200.

As shown in FIG. 4, the ports 250 may be aligned horizontally, such as in a plane, and spaced along the external sidewall 234 of the engine 200. As detailed below, this alignment and spacing may facilitate inline porting through the engine 200 from the fluid inlet pathway 130. For instance, each of the ports 250 may define an inlet flow direction A of the engine 200 (see FIG. 6) when the port is selected for operation (e.g., the first port 252 being selected when the showerhead 100 is in the first operation mode, the second port 254 being selected when the showerhead 100 is in the second operation mode, etc.). The inlet flow direction A may be substantially parallel to the fluid inlet pathway 130 to provide inline porting through the engine 200 from the fluid inlet pathway 130.

The external sidewall 234 may be fluidically sealed to the arm 120 to ensure a fluid tight interface between the engine 200 and the arm 120. Referring to FIGS. 2, 3, and 6, the showerhead 100 may include a sealing structure 350 to fluidically couple the fluid inlet pathway 130 with the selected port 250. As illustrated in FIG. 6, the sealing structure 350 may be received within a pocket 351 defined by the housing 102 at the intersection of the arm 120 and the spray head 106. The sealing structure 350 may include a seal or sealing member 352 movable in a radial direction relative to the engine 200 and a spring 354 biasing the seal 352 against the engine 200. The spring 354 may be seated against the arm 120 (e.g., against an internal shoulder 355 of the arm 120), and the seal 352 may be biased against the external sidewall 234 of the engine 200 by the spring 354. The seal 352 may define a single aperture 356 therethrough (see FIG. 2) to fluidically connect the fluid inlet pathway 130 and the selected port 250. As illustrated in FIG. 6, fluid may flow from the fluid inlet pathway 130, through an interior bore of the spring 354, through the aperture 356 of the seal 352, and into a selected port of the engine 200.

To facilitate rotation of the engine 200 relative to the housing 102, the external sidewall 234 of the engine 200 and the seal 352 may include corresponding curved surfaces. For example, as illustrated in FIG. 3, the external sidewall 234 of the engine 200 may include a convex outer surface 235, and the seal 352 may include a concave outer surface 353 for engaging the outer surface 235 of the external sidewall 234. Movement of the seal 352 via the spring 354 may facilitate rotation of the engine 200 relative to the spray head 106 while maintaining a fluid-tight seal between the fluid inlet pathway 130 and the selected port 250 of the engine 200. During rotation of the engine 200, the outer surface 235 of the external sidewall 234 of the engine 200 may slide along the outer surface 353 of the seal 352 while maintaining a fluid-tight seal therebetween.

The ports 250 may extend through various internal walls of the engine 200 to fluidically couple a respective port 250 to its respective flow pathway 210, 212, 214. Each one of the ports 250 may open through the external sidewall 234 of the engine 200 and may be selectively aligned with the aperture 356 in the seal 352 to be fluidically coupled to the fluid inlet pathway 130. One of the ports (e.g., the first port 252) may pass through the interior walls 240, 242 of the engine 200 to fluidically couple the fluid inlet pathway 130 with the first flow pathway 210 of the engine 200. Another one of the ports (e.g., the second port 254) may pass through the interior wall 242, but not the interior wall 240, of the engine 200 to fluidically couple the fluid inlet pathway 130 with the second flow pathway 212 of the engine 200. The other one of the ports (e.g., the third port 256) may pass through the exterior sidewall 234, but not the interior walls 240, 242, of the engine 200 to fluidically couple the fluid inlet pathway 130 with the third flow pathway 214 of the engine 200. In such examples, the engine 200 may include one or more conduits defined between the various walls to connect the ports with the various flow pathways of the engine 200. For instance, a first conduit 262 may be defined between the first interior wall 240, the second interior wall 242, and the third wall 244 to couple the first port 252 with the first flow pathway 210 of the engine 200. Similarly, a second conduit 264 may be defined between the second interior wall 242 and the third wall 244 to couple the second port 254 with the second flow pathway 212 of the engine 200. The third port 256 may open directly into the third flow pathway 214 of the engine 200, and thus a conduit may be omitted for the third port 256.

The engine 200 may include a massage mode assembly 300 positioned within the first flow pathway 210 to define a massage mode of the showerhead 100. The massage mode assembly 300 may be configured to alternatingly fluidically connect and disconnect a set of outlet nozzles 170 (e.g., the first nozzle group 172) with the first flow pathway 210 to provide a pulsating or intermittent spray pattern. The massage mode assembly 300 may include many configurations, including but not limited to those described in U.S. Publication No. 2016/0318046A1, the disclosure of which is hereby incorporated by reference in its entirety.

Figure 5:
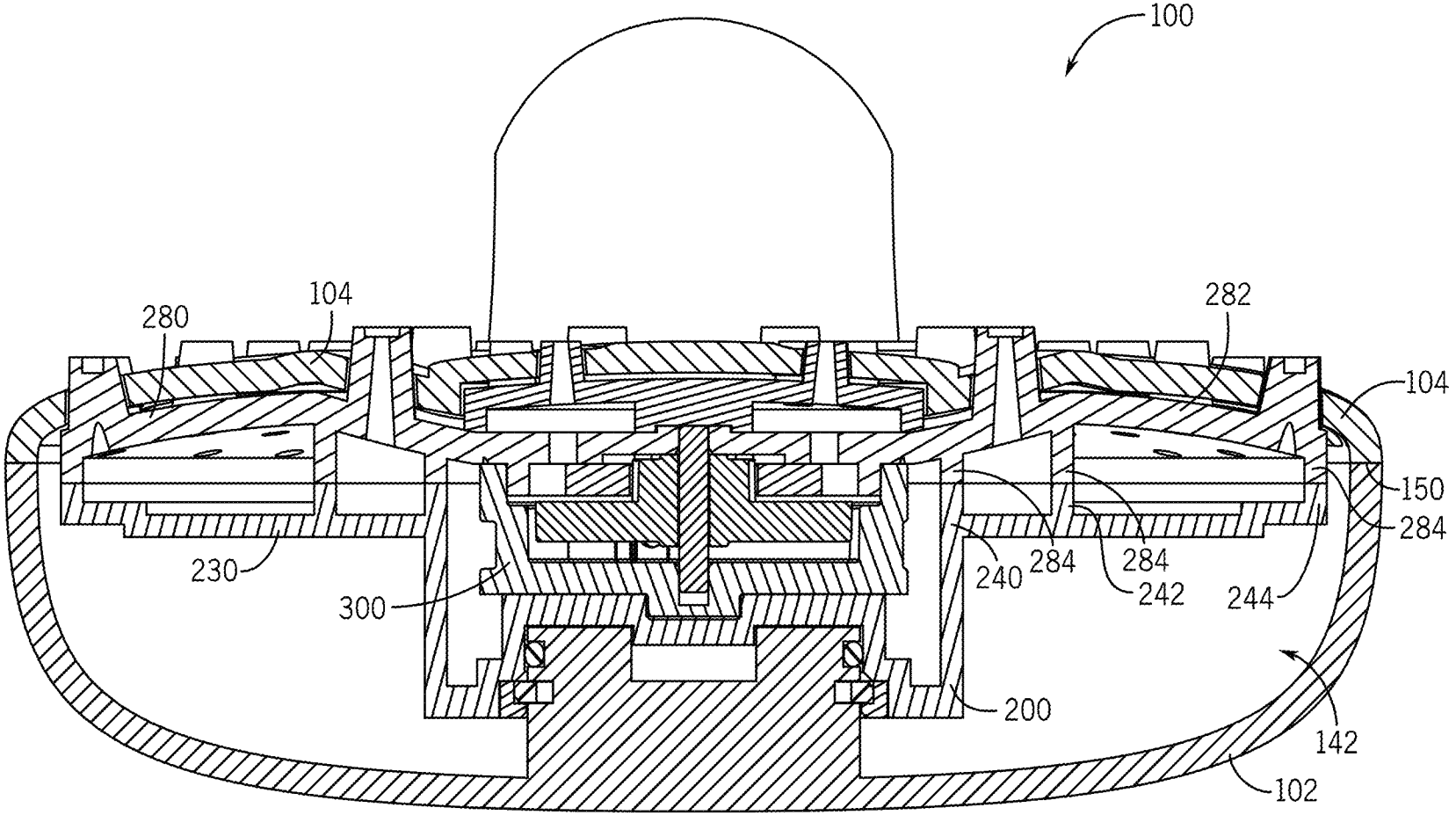
FIG. 5 is a cross-sectional view of the showerhead of FIG. 1 taken along line 5-5 in FIG. 1 according to some examples of the present disclosure.

Referring to FIGS. 2, 4, and 5, the engine 200 may include a nozzle plate 280 sealed against the flow control plate 230 to define the different flow pathways of the engine 200. For example, the nozzle plate 280 may be sealed against first, second, and third walls 240, 242, 244 of the flow control plate 230 to define the first, second, and third flow pathways 210, 212, 214 (see FIGS. 4 and 5). In the illustrative examples shown, the nozzle plate 280 includes a base 282 and a plurality of walls 284 extending from the base 282 (see FIG. 5). The plurality of walls 284 may be shaped for corresponding engagement with the walls 234 of the flow control plate 230, though other configurations are contemplated, including examples where the base 282 itself seals against the sidewalls 234 of the flow control plate 230.

The outlet nozzles 170 may be formed by the nozzle plate 280. The outlet nozzles 170 may extend from the base 282 of the nozzle plate 280. In such examples, the faceplate 104 may include corresponding apertures 290 allowing receipt of the outlet nozzles 170 at least partially therethrough. As best seen in FIG. 6, the outlet nozzles 170 may define an outlet flow direction B of the showerhead 100. In such examples, the outlet flow direction B may be at a non-parallel angle with the inlet flow direction A of the engine 200. For example, the outlet flow direction B may be at an orthogonal angle to the inlet flow direction A, though other non-parallel angles are contemplated.

Figure 7:
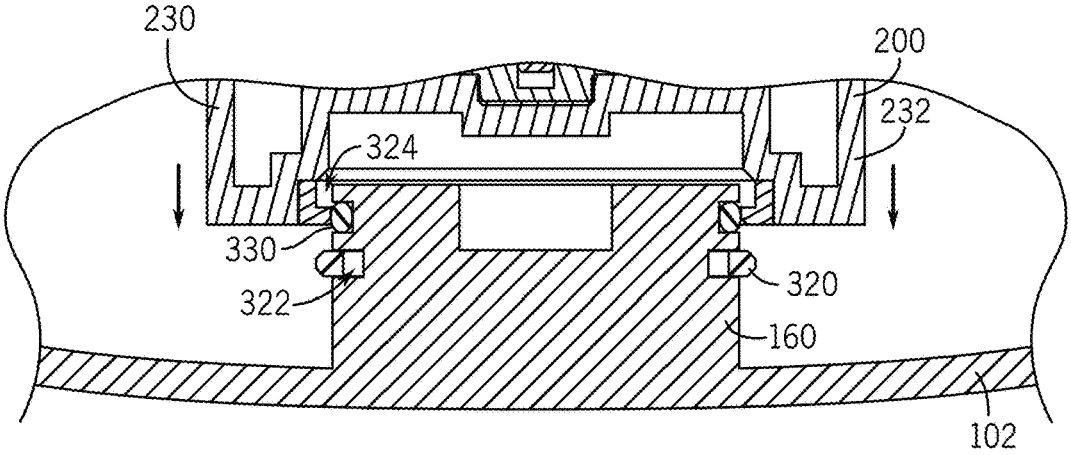
FIG. 7 is a cross-sectional view showing a first step of attaching the engine within the showerhead according to some examples of the present disclosure.
Figure 8:
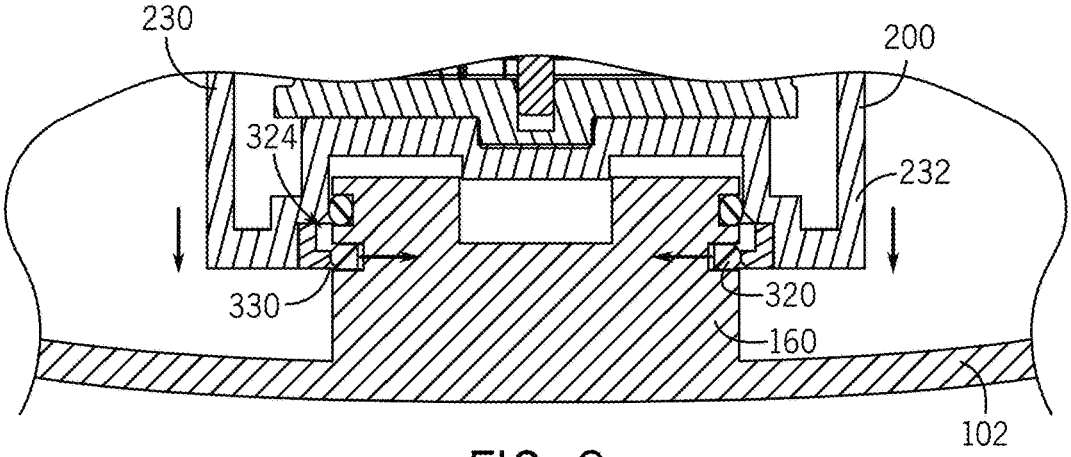
FIG. 8 is a cross-sectional view showing a second step of attaching the engine within the showerhead according to some examples of the present disclosure.
Figure 9:
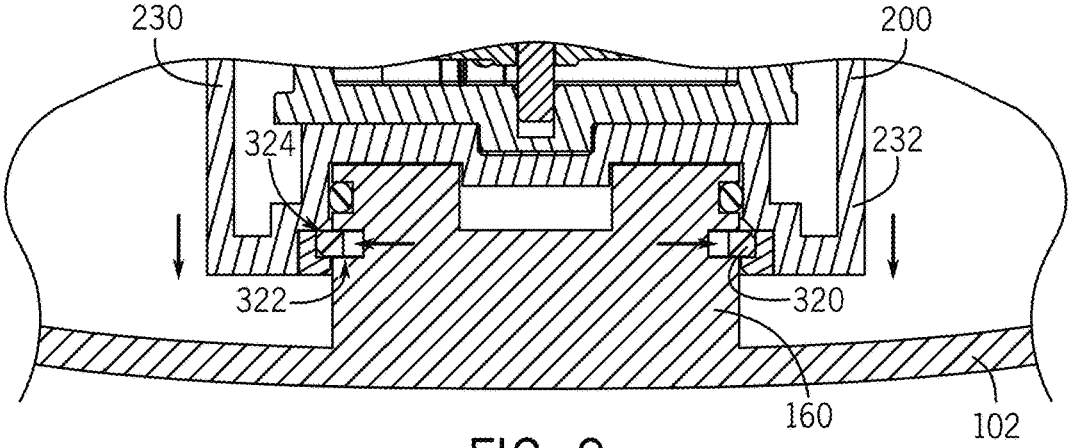
FIG. 9 is a cross-sectional view showing a completed attachment of the engine within the showerhead according to some examples of the present disclosure.

FIGS. 7-9 are cross-sectional views illustrating an example of the engine 200 coupled to the housing 102. Referring to FIGS. 7-9, the engine 200 may be rotatably mounted to the spray head 106. For example, the base wall 232 of the flow control plate 230 may be rotatably coupled to the spray head 106, such as rotatably coupled to a boss 160 protruding from the housing 102. In such examples, rotation of the engine 200 relative to the spray head 106 may selectively align the fluid inlet pathway 130 with one of the series of ports 250. For instance, rotation of the engine 200 to a first rotational position may align the fluid inlet pathway 130 with the first port 252, whereupon fluid flows from the fluid inlet pathway 130 and into the first flow pathway 210 of the engine 200 to actuate the first operation mode of the showerhead 100. Similarly, rotation of the engine 200 to a second rotational position may align the fluid inlet pathway 130 with the second port 254, whereupon fluid flows from the fluid inlet pathway 130 and into the second flow pathway 212 of the engine 200 to actuate the second operation mode of the showerhead 100. Rotation of the engine 200 to a third rotational position may align the fluid inlet pathway 130 with the third port 256, whereupon fluid flows from the fluid inlet pathway 130 and into the third flow pathway 214 of the engine 200 to actuate the third operation mode of the showerhead 100.

The engine 200 may be rotatably mounted to the spray head 106 in various manners. For instance, the engine 200 may be rotatably coupled to the spray head 106 via a snap ring 320. The snap ring 320 may be positioned between the spray head 106 and engine 200 to rotatably mount the engine 200 to the spray head 106. As shown in FIGS. 6-8, the spray head 106 may define a first annular groove 322, such as the first annular groove 322 being defined in the boss 160. The engine 200 may define a second annular groove 324, such as the second annular groove 324 being defined in the base wall 232. In such examples, the snap ring 320 may be received within the first annular groove 322 of the spray head 106 and the second annular groove 324 of the engine 200 to attach the engine 200 to the spray head 106. Once the engine 200 is coupled to the spray head 106, the snap ring 320 may be positioned at least partially within each of the first annular groove 322 and the second annular groove 324. The snap ring 320 may be retained on the spray head 106, such as seated within the first annular groove 322 of the spray head 106. As illustrated in FIGS. 2 and 3, the snap ring 320 may extend in a circular path with terminal ends separated from each other by a gap to form a split ring, thereby allowing contraction and expansion of the snap ring 320 during attachment of the engine 200 to the spray head 106. To enhance its retention force, the snap ring 320 may be substantially planar and extend in a substantially circular path with a varying radial dimension to ensure the snap ring 320 is sufficiently seated in both the first annular groove 322 of the spray head 106 and the second annular groove 324 of the engine 200. For example, the snap ring 320 may extend in an undulating pattern with radially outward portions of the snap ring 320 seated in the first annular groove 322 of the spray head 106 and radially inward portions of the snap ring 320 seated in the second annular groove 324 of the engine 200. The snap ring 320 may include a substantially constant thickness with the radially inward portions and the radially outward portions alternating with one another around the substantially circular path.

The snap ring 320 may be configured to facilitate attachment of the engine 200 to the spray head 106. For instance, the snap ring 320 may be chamfered to facilitate deformation of the snap ring 320 during attachment of the engine 200 to the spray head 106. The engine 200 may include a chamfered edge 330 for corresponding engagement with the chamfered snap ring 320. For instance, as the engine 200 is pressed onto the boss 160 of the spray head 106, the chamfered edge 330 of the engine 200 may engage the chamfered portion of the snap ring 320 (see FIG. 7). In such examples, further insertion of the engine 200 within the spray head 106 may move the snap ring 320 into the first annular groove 322, such as compressing the snap ring 320 into the first annular groove 322 (see FIG. 8), to allow the engine 200 to be seated onto the boss 160. As shown in FIG. 9, once the snap ring 320 is compressed sufficiently to allow further seating of the engine 200 onto the boss 160, further insertion of the engine 200 within the spray head 106 may allow the snap ring 320 to snap into the second annular groove 324 of the engine 200 to couple the engine 200 to the spray head 106. For example, further insertion of the engine 200 within the spray head 106 may allow the snap ring 320 to expand outwardly into the second annular groove 324 formed in the engine 200 as the second annular groove 324 aligns with the first annular groove 322. Once the snap ring 320 is positioned within the first annular groove 322 and the second annular groove 324, the engine 200 may be rotated about the boss 160 and relative to the spray head 106 to selectively align the fluid inlet pathway 130 with one of the series of ports 250 to permit fluid flow from the fluid inlet pathway 130 to the outlet nozzles 170.

FIGS. 6-8 illustrate one example of attaching the engine 200 to the spray head 106 using a snap ring 320. However, it will be appreciated that other configurations are contemplated. For example, an opposite configuration is suitable, where insertion of the engine 200 within a cavity of the spray head 106 expands the snap ring 320 into the first annular groove 322. In such examples, further insertion of the engine 200 within the spray head 106 may allow the snap ring 320 to snap inwardly into the second annular groove 324 formed in the engine 200 once the second annular groove 324 aligns with the first annular groove 322 to attach the engine 200 to the spray head 106. Additionally or alternatively, the engine may be attached to the housing using fasteners, heat or sonic welding, adhesive, or the like.

All relative and directional references (including: upper, lower, upward, downward, left, right, leftward, rightward, top, bottom, side, above, below, front, middle, back, vertical, horizontal, and so forth) are given by way of example to aid the reader's understanding of the examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

The present disclosure teaches by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A showerhead comprising:

a housing including an arm and defining a fluid inlet pathway along the length of the arm; and an engine rotatably mounted to the housing, the engine including a series of inlet ports opening through an external sidewall of the engine, the series of inlet ports extending transverse to a central axis of the engine, the series of inlet ports associated with different flow pathways defined within the engine;

wherein rotation of the engine relative to the housing selectively aligns the fluid inlet pathway inline with one of the series of inlet ports such that fluid flow through the fluid inlet pathway does not substantially change direction when entering an aligned inlet port of the series of inlet ports.

2. The showerhead of claim 1, wherein the series of ports are aligned in a horizontal plane and spaced around the external sidewall of the engine.

3. The showerhead of claim 1, wherein the external sidewall of the engine extends between a front surface and a rear surface of the engine.

4. The showerhead of claim 1, wherein each port of the series of ports is associated with a different operation mode of the showerhead.

5. The showerhead of claim 1, wherein each port of the series of ports is associated with a different flow pathway of the engine.

6. The showerhead of claim 1, further comprising an outlet nozzle defining an outlet flow direction oriented substantially perpendicular to the fluid inlet pathway.

7. The showerhead of claim 1, wherein a selected port of the series of ports defines an inlet flow direction of the engine, and the inlet flow direction is substantially parallel to the fluid inlet pathway.

8. The showerhead of claim 1, further comprising a seal positioned between the external sidewall of the engine and the housing to fluidically seal the fluid inlet pathway with a selected port of the series of ports.

9. The showerhead of claim 8, wherein the seal is movable in a radial direction relative to the external sidewall of the engine.

10. A showerhead comprising:

a housing defining a fluid inlet pathway;

an engine rotatably mounted to the housing, the engine including a series of inlet ports opening through an external sidewall of the engine, the series of ports associated with different flow pathways defined within the engine, wherein rotation of the engine relative to the housing selectively aligns the fluid inlet pathway with one of the series of ports;

a seal positioned between the external sidewall of the engine and the housing to fluidically seal the fluid inlet pathway with a selected port of the series of ports, wherein the seal is movable in a radial direction relative to the external sidewall of the engine; and a spring that biases the seal against the external sidewall.

11. The showerhead of claim 8, wherein the seal defines an aperture therethrough for fluidically coupling the fluid inlet pathway and the selected port of the series of ports.

12. The showerhead of claim 8, wherein the housing defines a handle and a spray head, and the seal is received in a pocket defined at an intersection of the handle and the spray head.

13. The showerhead of claim 1, wherein the housing defines a handle, and the fluid inlet pathway is defined within and extends along a length of the handle.

14. A showerhead comprising:

a housing including an arm defining a fluid inlet pathway along the length of the arm;

an engine rotatably mounted to the housing, the engine including a series of inlet ports opening through an external sidewall of the engine, the series of ports associated with different flow pathways defined within the engine;

wherein rotation of the engine relative to the housing selectively aligns the fluid inlet pathway with one of the series of ports with an inlet flow direction of the one of the series of ports inline with the fluid inlet pathway such that fluid flow through the fluid inlet pathway does not substantially change direction when entering an aligned port of the series of ports;

wherein the engine further includes a base wall rotatably coupled to the housing; and wherein a plurality of walls extend from the base wall to define the different flow pathways within the engine.

15. The showerhead of claim 14, wherein the plurality of walls comprises:

a first wall defining a first flow pathway with the base wall for a first operation mode of the showerhead;

a second wall defining a second flow pathway with the base wall and the first wall for a second operation mode of the showerhead; and a third wall defining a third flow pathway with the base wall and the second wall for a third operation mode of the showerhead.

16. The showerhead of claim 15, wherein:

a first conduit is defined between the first wall, the second wall, and the third wall to define at least a portion of the first flow pathway of the engine; and a second conduit is defined between the second wall and the third wall to define at least a portion of the second flow pathway of the engine.

17. The showerhead of claim 15, wherein:

one port of the series of ports extends through the first wall;

two ports of the series of ports extend through the second wall; and three ports of the series of ports extend through the third wall.

18. The showerhead of claim 15, further comprising a massage mode assembly positioned within the first flow pathway to define a massage mode of the showerhead.

19. The showerhead of claim 1, further comprising a snap ring positioned between the housing and engine to rotatably mount the engine to the housing.

20. The showerhead of claim 19, wherein:

the housing defines a first annular groove;

the engine defines a second annular groove; and the snap ring is received within the first annular groove of the housing and the second annular groove of the engine to attach the engine to the housing, wherein the engine is rotatable relative to the housing.

* * * * *